US007055689B2

(12) United States Patent
Chen

(10) Patent No.: US 7,055,689 B2
(45) Date of Patent: Jun. 6, 2006

(54) HANGER FOR WRENCHES

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 287 days.

(21) Appl. No.: 10/298,379

(22) Filed: Nov. 18, 2002

(65) Prior Publication Data

US 2004/0094444 A1 May 20, 2004

(51) Int. Cl.
*B65D 85/28* (2006.01)

(52) U.S. Cl. ..... 206/376; 206/349

(58) Field of Classification Search ..... 206/375, 206/376, 377, 372, 373, 379, 349; 220/786, 220/784; 211/70.6; 248/309.1
See application file for complete search history.

(56) References Cited

U.S. PATENT DOCUMENTS

| | | | |
|---|---|---|---|
| 2,035,340 | A | 3/1936 | Primavera |
| 2,438,989 | A | 4/1948 | Billman |
| 2,941,691 | A | 6/1960 | Weinberg |
| 3,081,056 | A | 3/1963 | Sweet et al. |
| 3,370,696 | A | 2/1968 | Gvoe |
| 3,630,344 | A | 12/1971 | Bergh |
| 3,878,939 | A | 4/1975 | Wilcox |
| 3,926,308 | A | 12/1975 | Sullivan |
| 3,997,053 | A | 12/1976 | Bondhus |
| 4,069,915 | A | 1/1978 | Schurman |
| 4,310,094 | A | 1/1982 | Hotchkiss |
| 4,372,468 | A | 2/1983 | Harvey |
| 4,501,354 | A | 2/1985 | Hoffman |
| 4,711,352 | A | 12/1987 | Williams et al. |
| 4,819,800 | A | 4/1989 | Wilson |
| 4,880,122 | A | 11/1989 | Martindell |
| 4,911,297 | A | 3/1990 | Suburu |
| 4,997,085 | A | 3/1991 | Brennan |
| 5,036,975 | A | 8/1991 | Chow |
| 5,044,591 | A | 9/1991 | Huang |
| 5,143,215 | A | 9/1992 | Hartley et al. |
| 5,322,256 | A | 6/1994 | Kanwischer |
| 5,335,772 | A | 8/1994 | Chervenak et al. |
| 5,346,063 | A | 9/1994 | Chow |
| D355,826 | S | 2/1995 | Chow |
| 5,415,315 | A | 5/1995 | Ramirez |
| 5,526,929 | A * | 6/1996 | Wei ..... 206/378 |
| 5,535,881 | A | 7/1996 | Krivec |
| 5,598,924 | A | 2/1997 | McCann |
| 5,638,964 | A | 6/1997 | Ernst |
| 5,659,440 | A | 8/1997 | Acosta et al. |
| 5,713,467 | A | 2/1998 | Kao |
| 5,730,303 | A | 3/1998 | Chow |
| 5,782,347 | A | 7/1998 | Fantone et al. |

(Continued)

FOREIGN PATENT DOCUMENTS

| | | |
|---|---|---|
| FR | 2701458 | 2/1993 |

(Continued)

*Primary Examiner*—Faye Francis
(74) *Attorney, Agent, or Firm*—Alan D. Kamrath; Nikolai & Mersereau, P.A.

(57) ABSTRACT

A hanger holds at least one wrench including a head and a handle. The hanger includes a first shell and a second shell for releasable engagement with the first shell. The first shell includes a board with a thickened portion and at least one recess defined in the thickened portion for receiving the handle of the at least one wrench. The first shell can be disengaged from the second shell for mounting of the at least one wrench mounted onto the first shell. The first shell can be engaged with the second shell for firmly holding the at least one wrench on the hanger.

10 Claims, 6 Drawing Sheets

U.S. PATENT DOCUMENTS 5,788,303 A * 8/1998 Chia-Hsiang ..... 294/143
5,803,253 A 9/1998 Zakarian
5,803,254 A * 9/1998 Vasudeva ..... 206/373
5,855,274 A 1/1999 Piao
5,887,715 A 3/1999 Vasudeva
D409,906 S 5/1999 Hu
5,899,329 A 5/1999 Hu et al.
5,918,741 A 7/1999 Vasudeva
5,931,299 A 8/1999 Hsieh
5,941,386 A 8/1999 Hu et al.
5,967,340 A 10/1999 Kao
5,975,297 A 11/1999 Kao
5,996,817 A 12/1999 Kao
6,039,188 A 3/2000 Lee
6,044,985 A 4/2000 Kao
6,068,123 A 5/2000 Chen
D426,151 S 6/2000 Ling
6,076,669 A 6/2000 Ling
6,092,656 A 7/2000 Ernst
6,098,799 A 8/2000 Lee
6,126,004 A * 10/2000 Ling ..... 206/377
D433,613 S 11/2000 Jialin
6,186,323 B1 2/2001 Jansson et al.
6,193,200 B1 2/2001 Kao
6,202,864 B1 3/2001 Ernst et al.
6,241,092 B1 6/2001 Vasudeva
6,241,208 B1 6/2001 Lin
6,257,409 B1 7/2001 Lin
D446,651 S 8/2001 Liao
6,283,311 B1 9/2001 Lee
6,315,119 B1 11/2001 Lee
6,315,121 B1 11/2001 Hansen
6,360,892 B1 3/2002 Chen
6,375,005 B1 4/2002 McCann
6,378,700 B1 4/2002 Tong
6,401,923 B1 6/2002 Huang
6,425,482 B1 7/2002 Chiang
6,464,840 B1 10/2002 McCann
6,481,583 B1 11/2002 Black et al.
6,508,360 B1 1/2003 Chen
6,536,611 B1 3/2003 Chen
D473,049 S 4/2003 Devine
6,564,949 B1 5/2003 Saathoff
6,637,606 B1 10/2003 Chen
6,655,529 B1 * 12/2003 Ho ..... 206/373
6,679,379 B1 1/2004 Kao
6,679,391 B1 1/2004 Huang
6,742,653 B1 * 6/2004 Kao ..... 206/373
6,758,350 B1 7/2004 Lin
6,827,210 B1 12/2004 Chen
6,837,382 B1 1/2005 Chen
6,840,389 B1 1/2005 Chen
2002/0175257 A1 11/2002 Yen
2003/0000902 A1 1/2003 Keis et al.
2003/0034316 A1 2/2003 Kao
2003/0102275 A1 6/2003 Kao
2003/0234196 A1 12/2003 Hu
2004/0035731 A1 * 2/2004 Lee ..... 206/349
2004/0069668 A1 * 4/2004 Finnigan ..... 206/372
2004/0094444 A1 5/2004 Chen
2004/0124106 A1 7/2004 Chen

FOREIGN PATENT DOCUMENTS

TW 319154 11/1997

* cited by examiner

HANGER FOR WRENCHES

BACKGROUND OF INVENTION

1. Field of Invention

The present invention relates to a hanger for wrenches.

2. Related Prior Art

Taiwan Patent Publication No. 319154 discloses a hanger for wrenches. The hanger 10 consists of a board 11 and a plurality of holders 14 formed on the board 11. Each holder 14 consists of two elastic prongs extending from the board 11 toward each other, thus defining a space 15 between the elastic prongs and a slit 16 between the tips of the elastic prongs. This conventional hanger is capable of holding a plurality of wrenches for display. However, the wrenches can be easily removed from the hanger and stolen.

The present invention is therefore intended to obviate or at least alleviate the problems encountered in the prior art.

SUMMARY OF INVENTION

It is the primary objective of the present invention to provide a security device for a hanger for wrenches.

According to the present invention, a hanger is provided for holding at least one wrench including a head and a handle. The hanger includes a first shell and a second shell for releasable engagement with the first shell. The first shell includes a board with a thickened portion and at least one recess defined in the thickened portion for receiving the handle of the at least one wrench. The first shell can be disengaged from the second shell for mounting of the at least one wrench mounted onto the first shell. The first shell can be engaged with the second shell for firmly holding the at least one wrench on the hanger.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF EMBODIMENTS

Referring to FIGS. 1~5, according to a first embodiment of the present invention, a hanger 1 includes a first shell 2 and a second shell 3 for releasable engagement with the first shell 2. The first shell 2 can be disengaged from the second shell 3 so that wrenches such as the one referred to by the numeral "4" can be mounted onto the first shell 2. The wrench 4 includes an upper head, a lower head and a handle formed between the upper and lower heads. The first shell 2 can be engaged with the second shell 3 so as to firmly hold the wrenches on the hanger 1.

Figure 1:
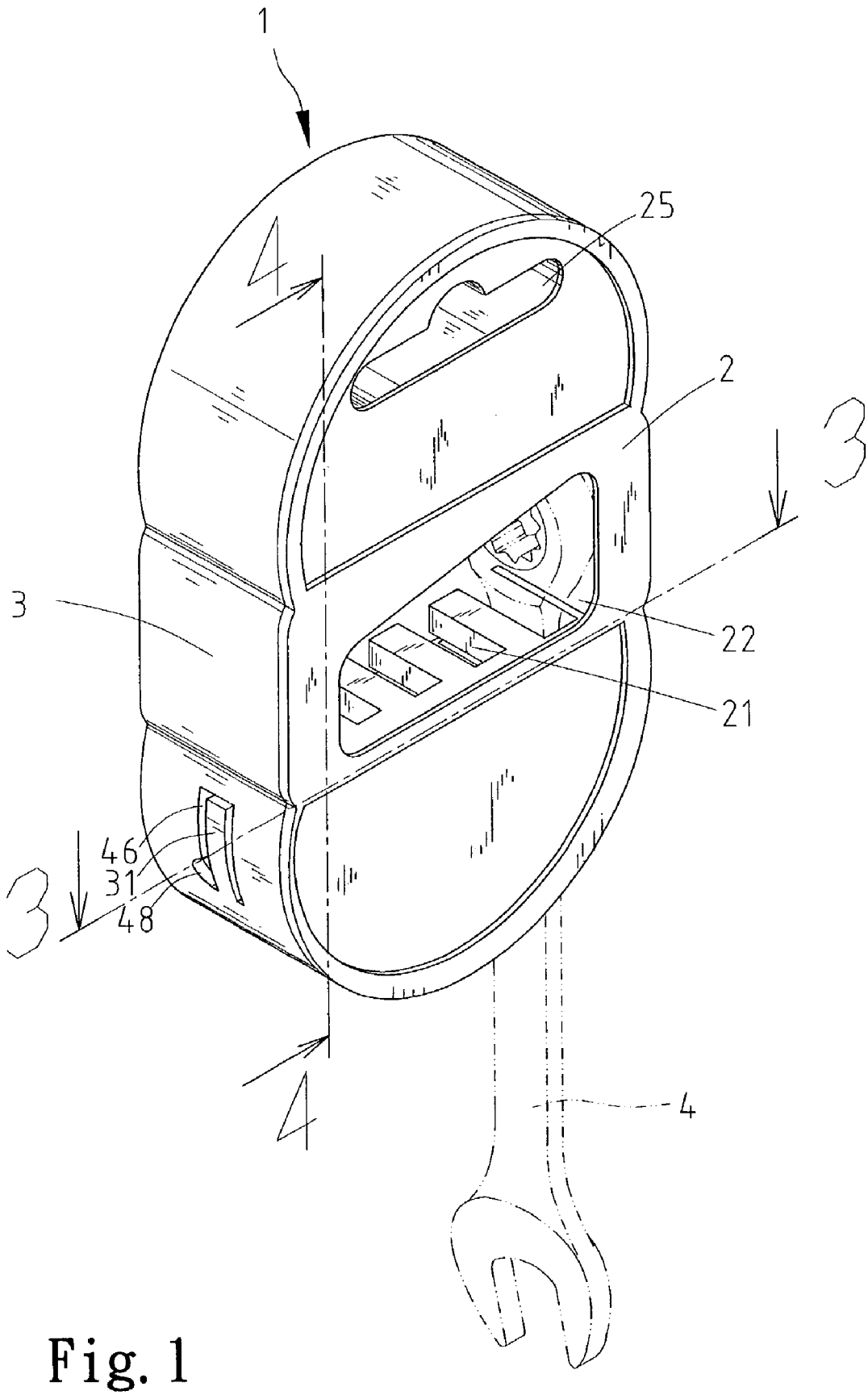
FIG. 1 is a perspective view of a hanger for wrenches according to a first embodiment of the present invention.
Figure 2:
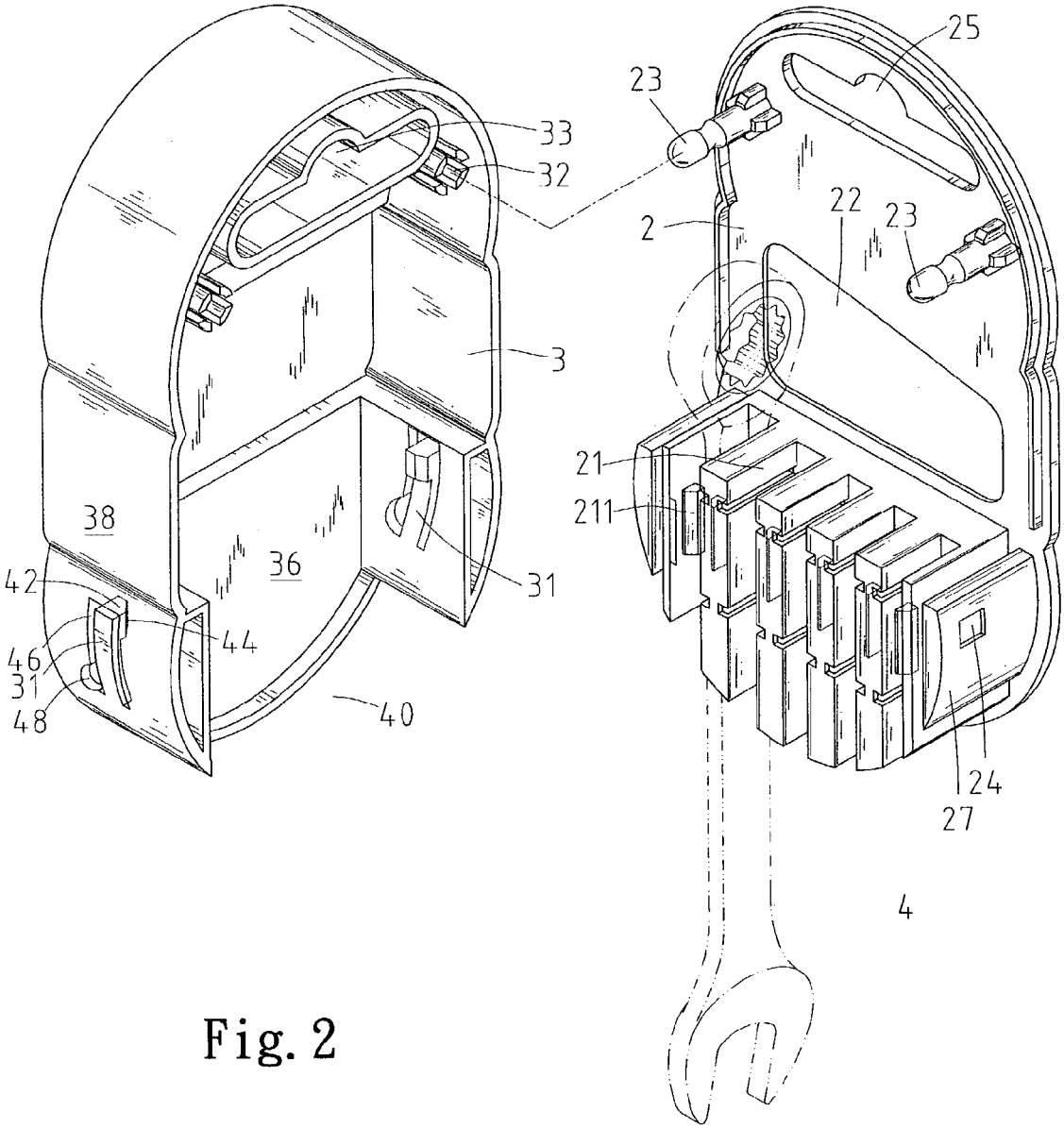
FIG. 2 is an exploded view of the hanger shown in FIG. 1, showing the hanger including a first shell and a second shell.

Referring to FIG. 2, the first shell 2 is substantially configured as a board with a thickened portion integrally formed as a single, non-separable component with the board. A plurality of recesses 21 is defined in the thickened portion of the first shell 2 for receiving the handles of a corresponding number of wrenches. Each of the recesses 21 is defined between two opposite sidewalls (not numbered). A stop 211 is formed on at least one of the sidewalls defining the recess 21. The stops 211 are useful for holding the wrenches on the first shell 2. A window 22 is defined in the first shell 2. Through the window 22, the upper heads of the wrenches can be observed. Two stems 23 are formed on the first shell 2. Each of the stems 23 includes a neck of a reduced diameter. A hole 24 is defined in each of two tabs 27 formed on the first shell 20. The thickened portion is located between the tabs 27. A hole 25 is defined in an upper portion of the first shell 2.

The second shell 3 includes a board 36 and a periphery 38 formed on the board 36. The periphery 38 includes a cutout 40 defined therein. Two tubes 32 are formed on the board 36. Each of the tubes 32 may include, at a free end, a plurality of claws (not numbered) separated from one another via a corresponding number of slits (not numbered). A hole 33 is defined in the board 36. The periphery 38 includes two lower portions each formed with an elastic strip 31. Each of the elastic strips 31 includes a stationary end integrated with each of the lower portions of the periphery 38 and a free end movable relative to each of the lower portions of the periphery 38. At the free end of each of the elastic strips 31 is formed a boss 42. Each of the bosses 42 is formed with an inclined face 44. Each of the elastic strips 31 is formed via punching or cutting one of the lower portions of the periphery 38 with a U-shaped slit 46. Each of the U-shaped slits 46 includes an enlarged portion 48. The handles of the wrenches are inserted through the cutout 40 when the upper heads of the wrenches are held between the first shell 2 and the second shell 3.

Figure 3:
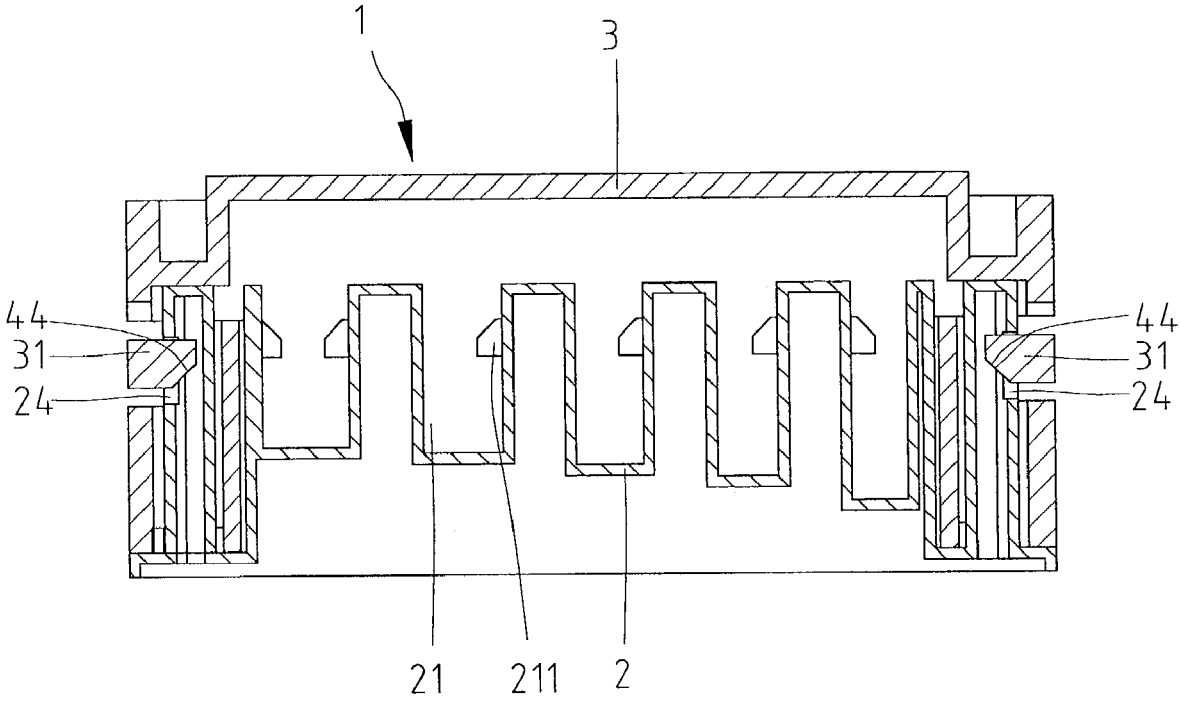
FIG. 3 is a cross-sectional view taken along a line 3—3 in FIG. 1.
Figure 4:
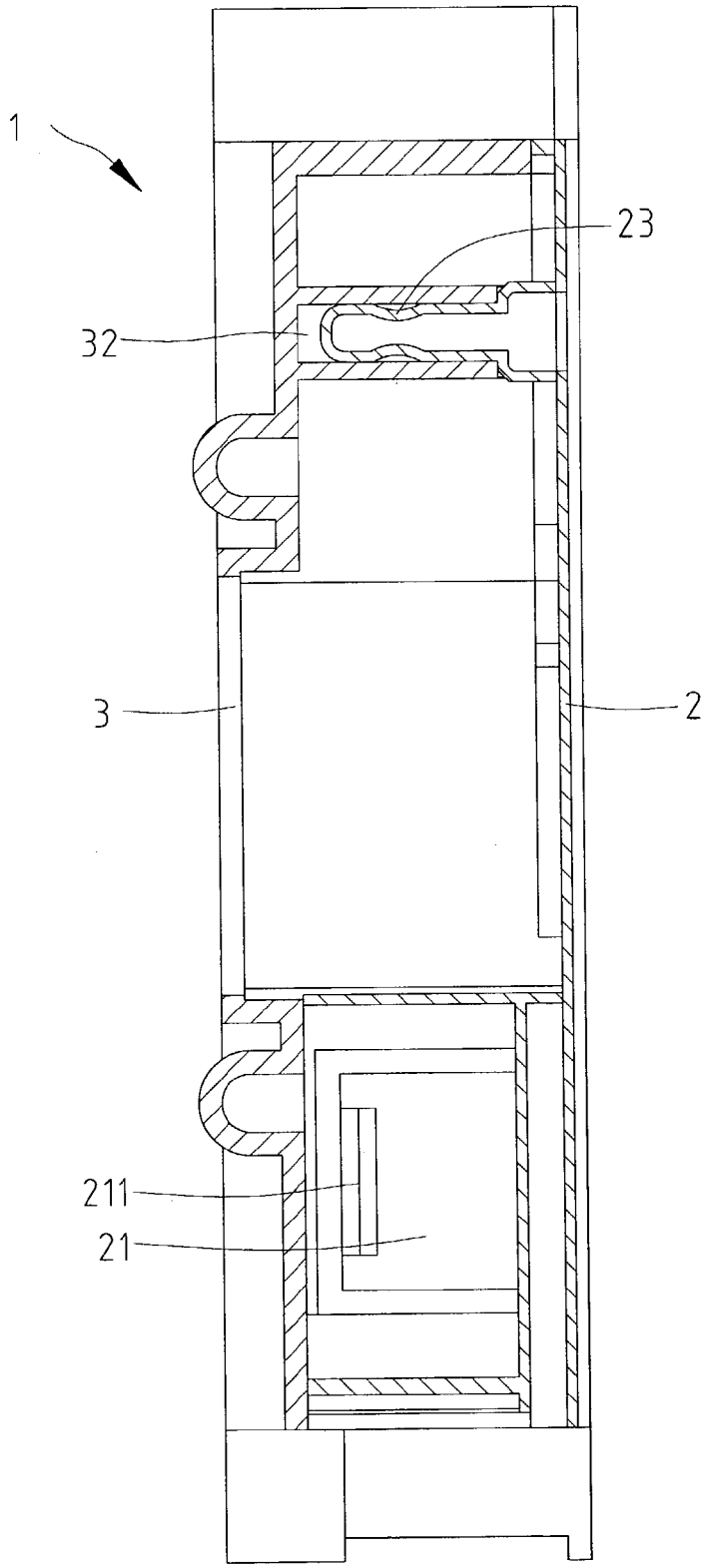
FIG. 4 is a cross-sectional view taken along a line 4—4 in FIG. 1.

In use, the handle of a wrench is received in one of the recesses 21 and is retained there by at least one stop 211. The first shell 2 is mounted on the second shell 3 for firmly holding the wrench between them. Referring to FIG. 3, the bosses 42 are inserted in the holes 24, thus retaining the first shell 2 on the second shell 3. Referring to FIG. 4, the stems 23 are inserted in the tubes 32 for alignment of the first shell 2 with the second shell 3. The inclined faces 44 and the elastic strips 31 facilitate sliding of the tabs 27 relative to the bosses 42. Due to the holes 25 and 33, the hanger 1 can be hung a nail on a wall. For disengagement of the first shell 2 from the second shell 3, the bosses 42 are removed from the holes 24 via pivoting of the elastic strips 31. The enlarged portions 48 of the U-shaped slits 46 facilitate the pivoting of the elastic strips 31.

Figure 5:
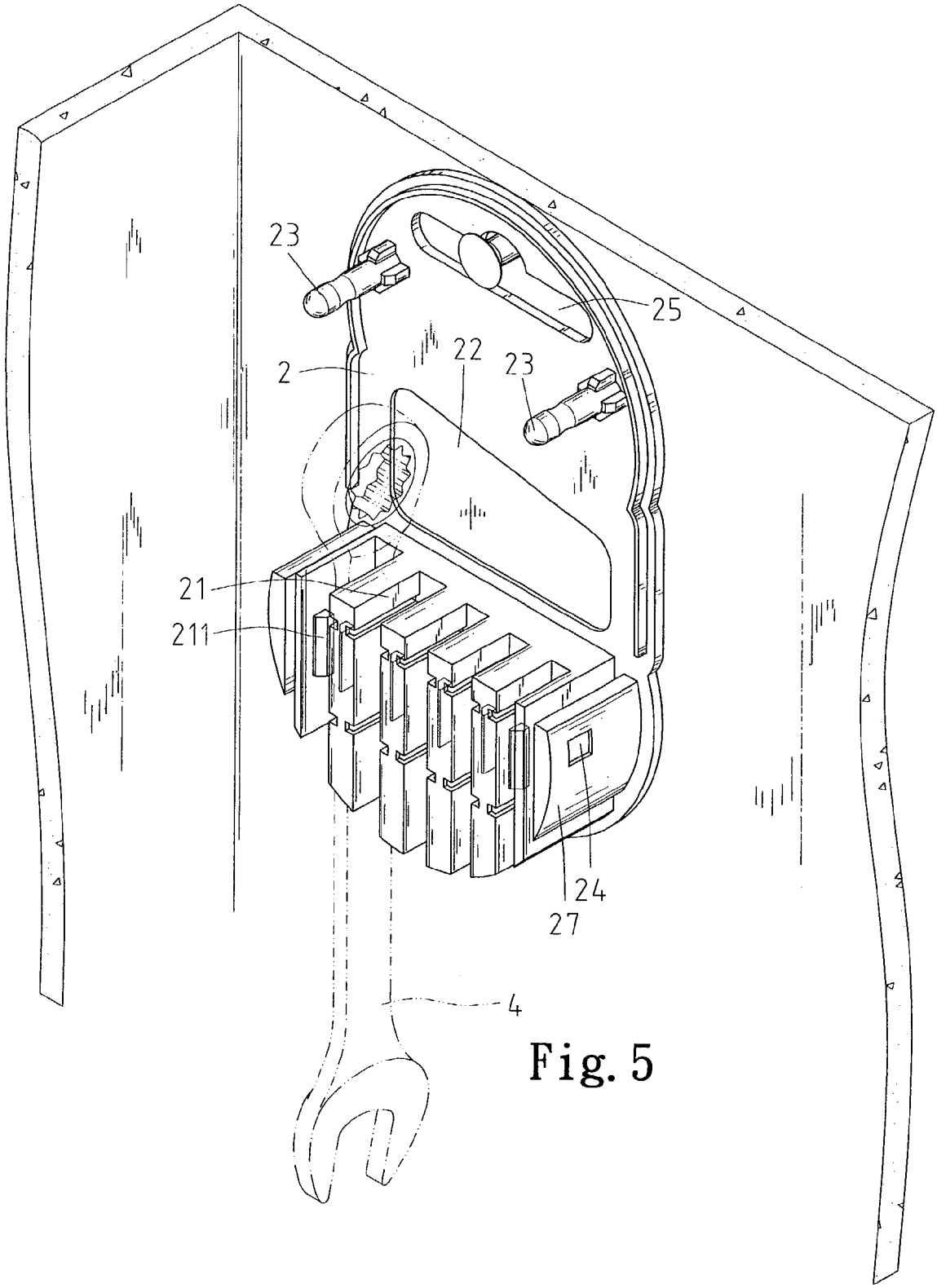
FIG. 5 is a perspective view of the first shell of the hanger shown in FIG. 2 when used independent of the second shell.

Referring to FIG. 5, the first shell 2 alone can be used to hold wrenches.

Figure 6:
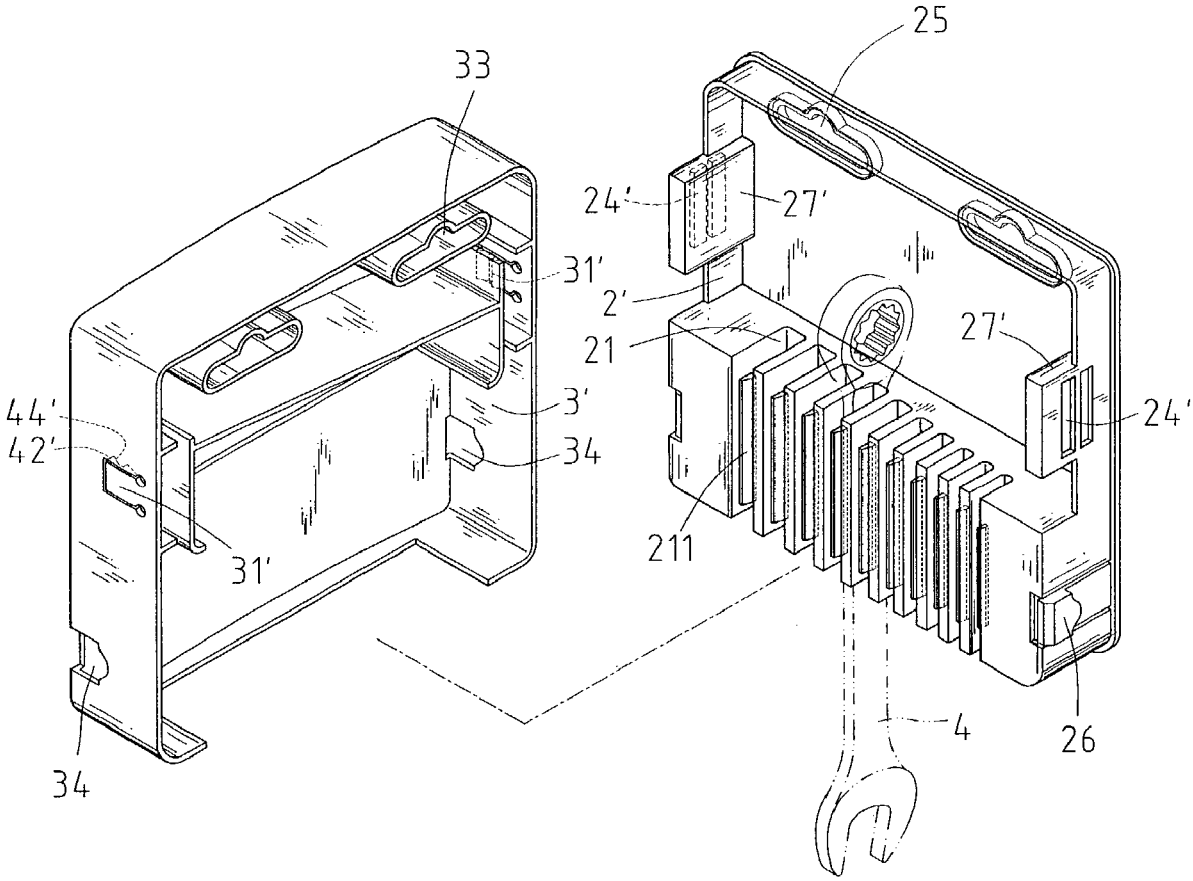
FIG. 6 is an exploded view of a hanger for wrenches according to a second embodiment of the present invention.

FIG. 6 shows a hanger according to a second embodiment of the present invention that includes a first shell 2' instead of the first shell 2 and a second shell 3' instead of the second shell 3.

The first shell 2' includes two tabs 27' instead of the tabs 27. Each of the tabs 27' includes two holes 24'. The first shell 2' does not include any stems like the stems 23. Two holes 25 are defined in the first shell 2'. On the first shell 2' are formed two hooks 26.

The second shell 3' does not include any tube like the tubes 32. The second shell 3' includes two elastic strips 31' instead of the elastic strips 31. Each of the elastic strips 31' includes two bosses 42' each formed with an inclined face 44'. The second shell 3' includes two holes 33 defined therein. For retaining the first shell 2' on the second shell 3', the bosses 42' are inserted in the holes 24', and the hooks 26 are engaged with the holes 34.

The second embodiment is identical to the first embodiment except for the features mentioned in the foregoing three paragraphs.

The present invention has been described via illustration of some embodiments. After a study of this specification, those skilled in the art can derive various variations from the embodiments. Therefore, the embodiments are only taken as examples and shall not limit the scope of the present invention defined in the following claims.

The invention claimed is:

1. A hanger for holding at least one wrench including a head and a handle, the hanger including: a first shell including a board, a thickened portion and at least one recess defined in the thickened portion and extending in a handle receiving direction for receiving the handle of the at least one wrench, with the board extending in the handle receiving direction above the thickened portion and the at least one recess, wherein the first shell defines a window in the board in the handle receiving direction above the thickened portion and through which the head of the at least one wrench can be observed;

a second shell for releasable engagement with the first shell, wherein the first shell can be disengaged from the second shell for mounting the at least one wrench onto the first shell and engaged with the second shell for holding the at least one wrench on the hanger; and a periphery on the second shell, with the periphery extending perpendicular to the board when the first and second shells are engaged and spaced in the handle receiving direction from the thickened portion, with the window located between the periphery and the thickened portion, wherein the first shell includes at least one stem formed on the board spaced from the thickened portion in the handle receiving direction, and the second shell includes at least one tube for receiving the at least one stem for alignment of the first shell with the second shell to releasably engage the second shell with the first shell spaced from the thickened portion, wherein the first shell includes two tabs which project at first and second locations on opposite sides of the thickened portion of the first shell and each of which defines a hole, wherein the second shell includes two bosses for insertion in the holes for retaining the first shell on the second shell at the first and second locations.

2. The hanger according to claim 1 wherein the at least one recess is defined between two opposite sidewalls at least one of which is formed with a stop for holding the at least one wrench on the first shell.

3. The hanger according to claim 1 wherein each of the bosses includes an inclined face formed thereon for smooth sliding of the tabs relative to the bosses.

4. A hanger for holding at least one wrench including a head and a handle, the hanger including:

a first shell including a board with a thickened portion and at least one recess defined in the thickened portion for receiving the handle of the at least one wrench; and a second shell for releasable engagement with the first shell, wherein the first shell can be disengaged from the second shell for mounting the at least one wrench onto the first shell and engaged with the second shell for holding the at least one wrench on the hanger, wherein the first shell includes two tabs each of which projects from the first shell and defines a hole, the second shell includes a board and a periphery that projects from the board and includes two lower portions each including a boss for insertion in the hole defined in a respective one of the tabs for retaining the first shell on the second shell, wherein each of the lower portions of the periphery includes an elastic strip each including a stationary end integrated therewith and a free end movable relative thereto, wherein the boss is formed on the free end of each of the elastic strips, wherein the elastic strip is formed via cutting each of the lower portions of the periphery with a U-shaped slit.

5. The hanger according to claim 4 wherein each of the U-shaped slits includes an enlarged portion for facilitating pivoting of the elastic strip.

6. A hanger for holding at least one wrench including a head and a handle, the hanger including:

a first shell including a board, a thickened portion and at least one recess defined in the thickened portion and extending in a handle receiving direction for receiving the handle of the at least one wrench, with the board extending in the handle receiving direction above the thickened portion and the at least one recess;

a second shell for releasable engagement with the first shell, wherein the first shell can be disengaged from the second shell for mounting the at least one wrench onto the first shell and engaged with the second shell for holding the at least one wrench on the hanger; and a periphery on the second shell, with the periphery extending perpendicular to the board when the first and second shells are engaged and spaced in the handle receiving direction from the thickened portion, wherein the first shell includes at least one stem formed on the board spaced from the thickened portion in the handle receiving direction, and the second shell includes at least one tube for receiving the at least one stem for alignment of the first shell with the second shell to releasably engage the second shell with the first shell spaced from the thickened portion, wherein the first shell includes two tabs which project at first and second locations on opposite sides of the thickened portion of the first shell and each of which defines a hole, wherein the second shell includes two bosses for insertion in the holes for retaining the first shell on the second shell at the first and second locations.

7. The hanger according to claim 6 wherein the first shell defines a window in the board in the handle receiving direction above the thickened portion and through which the head of the at least one wrench can be observed, with the window located between the periphery and the thickened portion.

8. The hanger according to claim 6 wherein the first shell includes two tabs each of which projects from the thickened portion of the first shell and defines a hole, the second shell includes a board; wherein the periphery projects from the board, the second shell includes two lower portions each including a boss for insertion in the hole defined in one of the tabs for retaining the first shell on the second shell at the first and second locations.

9. The hanger according to claim 8 wherein each of the lower portions of the periphery includes an elastic strip each including a stationary end integrated therewith and a free end movable relative thereto, wherein the boss is formed on the free end of each of the elastic strips.

10. The hanger according to claim 9 wherein each of the bosses includes an inclined face formed thereon for smooth sliding of the tabs relative to the bosses.

* * * * *